United States Patent [19]

Owen et al.

[11] Patent Number: 5,077,252

[45] Date of Patent: Dec. 31, 1991

[54] PROCESS FOR CONTROL OF MULTISTAGE CATALYST REGENERATION WITH PARTIAL CO COMBUSTION

[75] Inventors: Hartley Owen, Belle Mead, N.J.; Paul H. Schipper, Wilmington, Del.

[73] Assignee: Mobil Oil Corporation, Fairfax, Va.

[21] Appl. No.: 554,323

[22] Filed: Jul. 17, 1990

[51] Int. Cl.[5] ..... B01J 38/34; B01J 38/38; B01J 21/20; C10G 11/18

[52] U.S. Cl. ..... 502/43; 208/113; 208/164; 422/144; 502/40

[58] Field of Search ..... 502/40–44

[56] References Cited

U.S. PATENT DOCUMENTS

| | | | |
|---|---|---|---|
| 4,116,814 | 9/1978 | Zahner | 208/78 |
| 4,211,636 | 7/1980 | Gross et al. | 208/164 |
| 4,211,637 | 7/1980 | Gross et al. | 208/164 |
| 4,282,084 | 8/1981 | Gross et al. | 208/DIG. 1 |
| 4,283,273 | 8/1981 | Owen | 208/113 |
| 4,812,430 | 3/1989 | Child | 502/42 |
| 4,820,404 | 4/1989 | Owen | 502/44 |
| 4,849,091 | 7/1989 | Cabrera et al. | 108/113 |
| 4,875,994 | 10/1989 | Haddad et al. | 502/49 |
| 4,917,790 | 4/1990 | Owen | 208/155 |

*Primary Examiner*—Paul E. Konopka
*Attorney, Agent, or Firm*—A. J. McKillop; C. J. Speciale; Richard D. Stone

[57] ABSTRACT

A process and apparatus for controlled, multi-stage regeneration of FCC catalyst is disclosed. A modified high efficiency catalyst regenerator, with a fast fluidized bed coke combustor, dilute phase transport riser, and second fluidized bed regenerates the catalyst in at least two stages. The primary stage of regeneration is in the coke combustor. Second stage catalyst regeneration occurs in the second fluidized bed. The amount of combustion air added to both regeneration stages is set to maintain partial CO combustion in both stages. Controlled multi-stage regeneration reduces the steaming or deactivation of catalyst during regeneration, maximizes coke burning capacity of the regenerator, and minimizes or eliminates NOx emissions.

12 Claims, 4 Drawing Sheets

PROCESS FOR CONTROL OF MULTISTAGE CATALYST REGENERATION WITH PARTIAL CO COMBUSTION

BACKGROUND OF THE INVENTION

1. Field of the Invention

The field of the invention is regeneration of coked cracking catalyst in a fluidized bed.

2. Description of Related Art

Catalytic cracking is the backbone of many refineries. It converts heavy feeds to lighter products by cracking large molecules into smaller molecules. Catalytic cracking operates at low pressures, without hydrogen addition, in contrast to hydrocracking, which operates at high hydrogen partial pressures. Catalytic cracking is inherently safe as it operates with very little oil actually in inventory during the cracking process.

There are two main variants of the catalytic cracking process: moving bed and the far more popular and efficient fluidized bed process.

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425° C.-600° C., usually 460° -560° C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500° C.-900° C., usually 600° C.-750° C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking is endothermic, it consumes heat. The heat for cracking is supplied at first by the hot regenerated catalyst from the regenerator. Ultimately, it is the feed which supplies the heat needed to crack the feed. Some of the feed deposits as coke on the catalyst, and the burning of this coke generates heat in the regenerator, which is recycled to the reactor in the form of hot catalyst.

Catalytic cracking has undergone progressive development since the 40s. The trend of development of the fluid catalytic cracking (FCC) process has been to all riser cracking and use of zeolite catalysts.

Riser cracking gives higher yields of valuable products than dense bed cracking. Most FCC units now use all riser cracking, with hydrocarbon residence times in the riser of less than 10 seconds, and even less than 5 seconds.

Zeolite-containing catalysts having high activity and selectivity are now used in most FCC units. These catalysts work best when coke on the catalyst after regeneration is less than 0.2 wt %, and preferably less than 0.05 wt %.

To regenerate FCC catalysts to these low residual carbon levels, and to burn CO completely to CO2 within the regenerator (to conserve heat and minimize air pollution) many FCC operators add a CO combustion promoter metal to the catalyst or to the regenerator.

U.S. Pat. Nos. 4,072,600 and 4,093,535, which are incorporated by reference, teach use of combustion-promoting metals such as Pt, Pd, Ir, Rh, Os, Ru and Re in cracking catalysts in concentrations of 0.01 to 50 ppm, based on total catalyst inventory.

As the process and catalyst improved, refiners attempted to use the process to upgrade a wider range of feedstocks, in particular, feedstocks that were heavier, and also contained more metals and sulfur than had previously been permitted in the feed to a fluid catalytic cracking unit.

These heavier, dirtier feeds have placed a growing demand on the regenerator. Processing resids has exacerbated existing problem areas in the regenerator, steam, temperature and NOx. These problems will each be reviewed in more detail below.

Steam

Steam is always present in FCC regenerators although it is known to cause catalyst deactivation. Steam is not intentionally added, but is invariably present, usually as absorbed or entrained steam from steam stripping of catalyst or as water of combustion formed in the regenerator.

Poor stripping leads to a double dose of steam in the regenerator, first from the adsorbed or entrained steam and second from hydrocarbons left on the catalyst due to poor catalyst stripping. Catalyst passing from an FCC stripper to an FCC regenerator contains hydrogen-containing components, such as coke or unstripped hydrocarbons adhering thereto. This hydrogen burns in the regenerator to form water and cause hydrothermal degradation.

U.S. Pat. No. 4,336,160 to Dean et al, which is incorporated by reference, attempts to reduce hydrothermal degradation by staged regeneration.

Steaming of catalyst becomes more of a problem as regenerators get hotter. Higher temperatures accelerate the deactivating effects of steam.

Temperature

Regenerators are operating at higher and higher temperatures. This is because most FCC units are heat balanced, that is, the endothermic heat of the cracking reaction is supplied by burning the coke deposited on the catalyst. With heavier feeds, more coke is deposited on the catalyst than is needed for the cracking reaction. The regenerator gets hotter, and the extra heat is rejected as high temperature flue gas. Many refiners severely limit the amount of resid or similar high CCR feeds to that amount which can be tolerated by the unit. High temperatures are a problem for the metallurgy of many units, but more importantly, are a problem for the catalyst. In the regenerator, the burning of coke and unstripped hydrocarbons leads to much higher surface temperatures on the catalyst than the measured dense bed or dilute phase temperature. This is discussed by Occelli et al in Dual-Function Cracking Catalyst Mixtures, Ch. 12, Fluid Catalytic Cracking, ACS Symposium Series 375, American Chemical Society, Washington, D.C., 1988.

Some regenerator temperature control is possible by adjusting the CO/CO2 ratio produced in the regenerator. Burning coke partially to CO produces less heat than complete combustion to $CO_2$. Control of $CO/CO_2$ ratios is fairly straightforward in single, bubbling bed regenerators, by limiting the amount of air that is added. It is far more difficult to control $CO/CO_2$ ratios when multi-stage regeneration is involved.

U.S. Pat. No. 4,353,812 to Lomas et al, which is incorporated by reference, discloses cooling catalyst from a regenerator by passing it through the shell side of a heat-exchanger with a cooling medium through the tube side. The cooled catalyst is recycled to the regeneration zone. This approach will remove heat from the regenerator, but will not prevent poorly, or even well, stripped catalyst from experiencing very high surface or localized temperatures in the regenerator.

The prior art also used dense or dilute phase regenerated fluid catalyst heat removal zones or heat-exchangers that are remote from, and external to, the regenerator vessel to cool hot regenerated catalyst for return to the regenerator. Examples of such processes are found in U.S. Pat. Nos. 2,970,117 to Harper; 2,873,175 to Owens; 2,862,798 to McKinney; 2,596,748 to Watson et al; 2,515,156 to Jahnig et al; 2,492,948 to Berger; and 2,506,123 to Watson.

NOx

Burning of nitrogenous compounds in FCC regenerators has long led to creation of minor amounts of NOx, some of which were emitted with the regenerator flue gas. Usually these emissions were not much of a problem because of relatively low temperature, a relatively reducing atmosphere from partial combustion of CO and the absence of catalytic metals like Pt in the regenerator which increase NOx production.

Unfortunately, the trend to heavier feeds usually means that the amount of nitrogen compounds on the coke will increase and that NOx emissions will increase. Higher regenerator temperatures also tend to increase NOx emissions. It would be beneficial, in many refineries, to have a way to burn at least a large portion of the nitrogenous coke in a relatively reducing atmosphere, so that much of the NOx formed could be converted into $N_2$ within the regenerator. Unfortunately, existing multi-stage regenerator designs can not be run with two stages of regeneration, both operating with partial CO combustion, i.e., with a reducing atmosphere.

High Efficiency Regenerator

Most new FCC units use a high efficiency regenerator, which uses a fast fluidized bed coke combustor to burn most of the coke from the catalyst, and a dilute phase transport riser above the coke combustor to afterburn CO to $CO_2$ and achieve a limited amount of additional coke combustion. Hot regenerated catalyst and flue gas are discharged from the transport riser, separated, and the regenerated catalyst collected as a second bed, a bubbling dense bed, for return to the FCC reactor and recycle to the coke combustor to heat up incoming spent catalyst.

Such regenerators are now widely used. They typically are operated to achieve complete CO combustion within the dilute phase transport riser. They achieve one stage of regeneration, i.e., essentially all of the coke is burned in the coke combustor, with minor amounts being burned in the transport riser. The residence time of the catalyst in the coke combustor is on the order of a few minutes, while the residence time in the transport riser is on the order of a few seconds, so there is generally not enough residence time of catalyst in the transport riser to achieve any significant amount of coke combustion.

Catalyst regeneration in such high efficiency regenerators is essentially a single stage of regeneration, in that the catalyst and regeneration gas and produced flue gas remain together from the coke combustor through the dilute phase transport riser. Almost no further regeneration of catalyst occurs downstream of the coke combustor, because very little air is added to the second bed, the bubbling dense bed used to collect regenerated catalyst for recycle to the reactor or the coke combustor. Usually enough air is added to fluff the catalyst, and allow efficient transport of catalyst around the bubbling dense bed. Less than 5%, and usually less than 1%, of the coke combustion takes place in the second dense bed.

Such units are popular in part because of their efficiency, i.e., the fast fluidized bed, with recycle of hot regenerated catalyst, is so efficient at burning coke that the regenerator can operate with only half the catalyst inventory required in an FCC unit with a bubbling dense bed regenerator.

With the trend to heavier feedstocks, the catalyst regenerator is frequently pushed to the limit of its coke burning capacity. Addition of cooling coils, as discussed above in the Temperature discussion, helps some, but causes additional problems. High efficiency regenerators run best when run in complete CO combustion mode, so attempts to shift some of the heat of combustion to a downstream CO boiler are difficult to implement.

We realized that there was a need for a better way to run a high efficiency regenerator, so that several stages of catalyst regeneration could be achieved in the existing hardware. We also wanted a reliable and efficient way of controlling the amount of regeneration that occurred in each stage, so that partial combustion of CO would be maintained in both stages. This presented difficult control problems, because essentially all commercial experience with these units has been in single stage operation, with complete CO combustion. Maintaining partial CO combustion in a high efficiency regenerator is a challenge, and operating the unit so that two stages of regeneration are achieved, and maintaining both stages in partial CO burn mode, presents a real challenge.

Part of the problem of multi-stage regeneration, with partial CO burn in each stage, is the difficulty of ensuring that the proper amount of coke burning occurs in each stage. If the unit operation does not change, then frequent material or carbon balances around the regenerator can be used to adjust the amount of combustion air that is added to each stage of the regenerator. Unfortunately, the only certainty in commercial FCC operation is change. Feed quality frequently changes, the product slate required varies greatly between winter and summer, catalyst ages, and equipment breaks. If coke burning gets behind, in e.g., the second stage of the regenerator, the unit must be able to catch up on coke burning, without adding so much air that dilute phase afterburning occurs above the second dense bed. Such afterburning, where there is very little catalyst around to absorb the heat of combustion, can rapidly lead to high temperatures which can damage the cyclones, or downstream flue gas treatment processes.

We studied these units, and realized that were several ways to reliably achieve two stages of combustion, while keeping both stages operating in partial CO combustion mode. Our control method makes it easier to minimize hydrothermal degradation of catalyst, increases the coke burning capacity of existing high efficiency regenerators without requiring significant additional vessel construction. Regenerator temperatures can be reduced somewhat for some parts of the regenerator. We greatly reduce or eliminate NOx emissions, and greatly reduces the amount of catalyst steaming that occurs. We are also able to greatly mitigate the formation of highly oxidized forms of vanadium, permitting the unit to tolerate much higher metals levels without excessive loss of catalyst activity or adverse effects in the cracking reactor.

BRIEF SUMMARY OF THE INVENTION

Accordingly, the present invention provides a process for regenerating spent fluidized catalytic cracking catalyst used in a catalytic cracking process wherein a heavy hydrocarbon feed stream is preheated in a preheating means, catalytically cracked in a cracking reactor by contact with a source of hot, regenerated cracking catalyst to produce cracked products and spent catalyst which is regenerated in a high efficiency fluidized catalytic cracking catalyst regenerator comprising a fast fluidized bed coke combustor having at least one inlet for spent catalyst, at least one inlet for regeneration gas, and an outlet to a superimposed dilute phase transport riser having an inlet at the base connected to the coke combustor and an outlet the top connected to a separation means which separates catalyst and primary flue gas and discharges catalyst into a second fluidized bed, to produce regenerated cracking catalyst comprising regenerating said spent catalyst in at least two stages, and maintaining partial CO combustion in both stages by: partially regenerating said spent catalyst with a controlled amount, sufficient to burn from 10 to 90% of the coke on the spent catalyst to carbon oxides, of a primary regeneration gas comprising oxygen or an oxygen containing gas in a primary regeneration zone comprising said coke combustor and transport riser and discharging from the transport riser partially regenerated catalyst and a primary flue gas stream; completing the regeneration of said partially regenerated catalyst with a set amount of a secondary regeneration gas comprising oxygen or an oxygen containing gas in a secondary regeneration zone comprising said bubbling fluidized bed and burn additional coke to carbon oxides; and controlling the amount of primary and secondary regeneration gas relative to coke on spent catalyst to limit combustion of coke in each regeneration stage to produce a flue gas from each stage comprising at least 1 mole % CO.

In another embodiment, the present invention provides a fluidized catalytic cracking process wherein a heavy hydrocarbon feed comprising hydrocarbons having a boiling point above about 650° F. is catalytically cracked to lighter products comprising the steps of: catalytically cracking the feed in a catalytic cracking zone operating at catalytic cracking conditions by contacting the feed with a source of hot regenerated catalyst to produce a cracking zone effluent mixture having an effluent temperature and comprising cracked products and spent cracking catalyst containing coke and strippable hydrocarbons; separating the cracking zone effluent mixture into a cracked product rich vapor phase and a solids rich phase having a temperature and comprising the spent catalyst and strippable hydrocarbons; stripping the catalyst mixture with a stripping gas to remove strippable compounds from spent catalyst; regenerating in a primary regeneration stage the stripped catalyst by contact with a set amount of a primary combustion gas comprising oxygen or an oxygen containing gas in a fast fluidized bed coke combustor having at least one inlet for primary combustion gas and for spent catalyst, and an overhead outlet for at least partially regenerated catalyst and flue gas, transporting partially regenerated catalyst from said coke combustor up into a contiguous, superimposed, dilute phase transport riser having an opening at the base connective with the coke combustor and an outlet at an upper portion thereof for discharge of partially regenerated catalyst and primary flue gas comprising at least 1 mole % CO; discharging and separating the primary flue gas from partially regenerated catalyst and a collecting said partially regenerated catalyst as a bubbling fluidized bed of catalyst in a secondary regeneration zone; maintaining an inventory of catalyst in the second fluidized dense bed sufficient to provide a catalyst residence time therein of at least about 1 minute; regenerating the partially regenerated catalyst in the second dense bed by adding to the second fluidized bed a set amount of a secondary regeneration gas comprising oxygen or oxygen containing gas in an amount equal to at least 10% of the primary regeneration gas and maintaining a superficial vapor velocity in said second fluidized bed of at least 0.25 feet per second and removing in said second fluidized bed at least 10% of the carbon content of the coke, and produce regenerated catalyst and a secondary flue gas stream comprising at least 1 mole % CO; and recycling to the catalytic cracking process hot regenerated catalyst from said second fluidized bed.

In an apparatus embodiment, the present invention provides an apparatus for the fluidized catalytic cracking of a heavy hydrocarbon feed to lighter products comprising a feed preheater means and feed flow control means adapted to produce a set amount of a preheated hydrocarbon feed; a riser cracking reactor means having an inlet in the base thereof for hydrocarbon feed and a source of hot, regenerated cracking catalyst and an outlet for cracked products and spent catalyst; a spent catalyst stripper means adapted to receive spent catalyst discharged from said reactor means and contact said spent catalyst with a stripping gas to produce stripped spent catalyst; a fast fluidized bed coke combustor means having at least one inlet for said stripped spent catalyst, at least one inlet for primary regeneration gas, and an outlet; a dilute phase transport riser means superimposed above said coke combustor means and having an inlet at a base thereof connected with the coke combustor outlet and a transport riser outlet at a top thereof for the discharge of partially regenerated catalyst and primary flue gas; a separation means connected to said transport riser outlet which separates catalyst and primary flue gas and discharges catalyst into a second fluidized bed; a secondary regeneration means comprising said second fluidized dense bed and having an inlet in a lower portion of said second fluidized dense bed for a set amount of secondary regeneration gas and an outlet for regenerated catalyst and a flue gas outlet for a secondary flue gas in an upper portion thereof; a regeneration gas flow control means adapted to receive an input signal indicative of at least one of a secondary flue gas composition or a differential temperature indicative of afterburning in said secondary flue gas stream and control at least one the feed rate, the feed preheat, or the total amount of regeneration air added to said regeneration means to apportion coke combustion between said primary and said secondary regeneration means.

DETAILED DESCRIPTION

Figure 1:
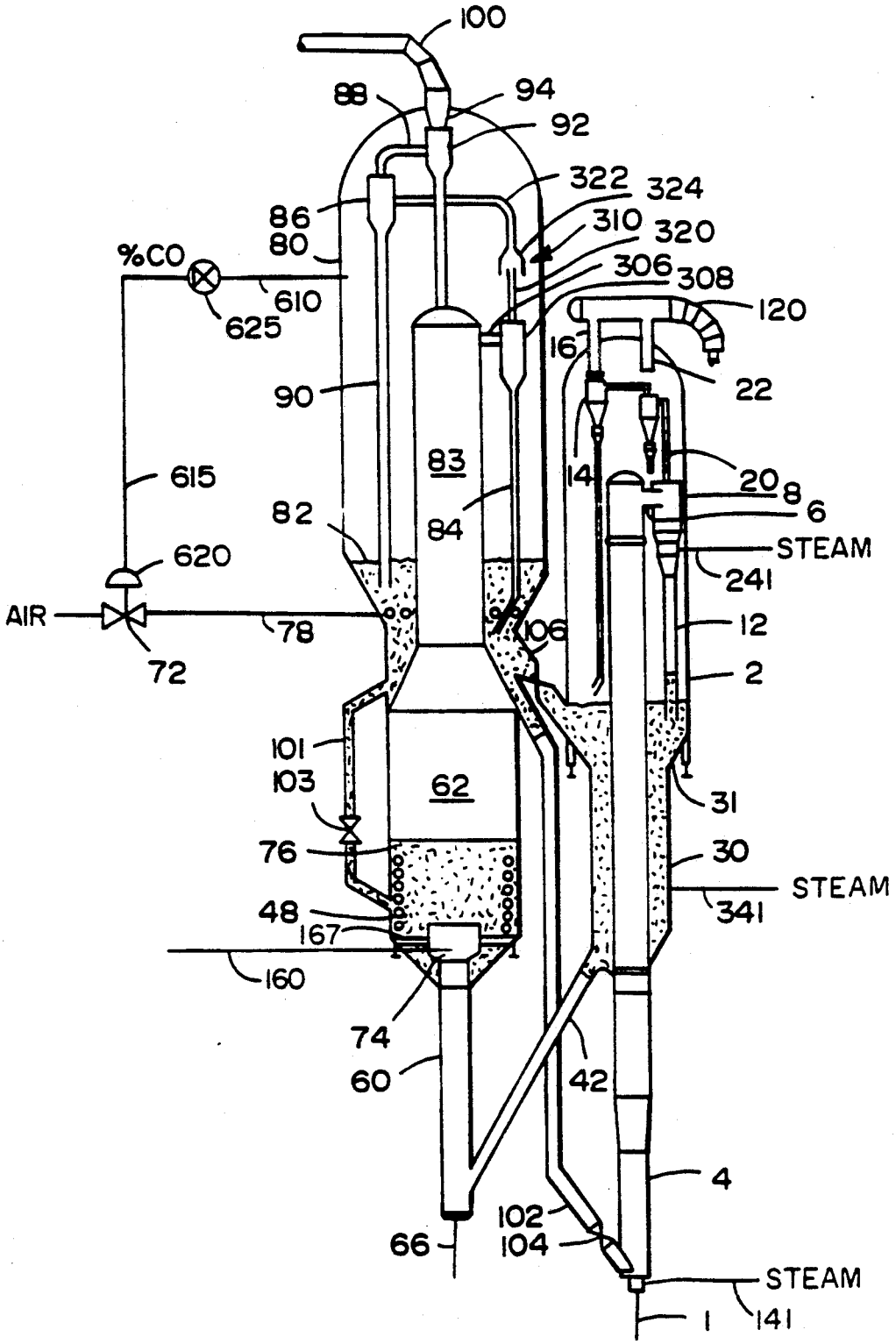
FIG. 1 is a simplified schematic view of one embodiment of the invention using flue gas composition to control air addition to the second dense bed of a multistage FCC high efficiency regenerator.

The present invention can be better understood by reviewing it in conjunction with the Figures, which illustrate preferred high efficiency regenerators incorporating the process control scheme of the invention. The present invention is applicable to other types of high efficiency regenerators, such as those incorporating additional catalyst flue gas separation means in various parts of the regenerator.

In all figures the FCC reactor section is the same. A heavy feed is charged via line 1 to the lower end of a riser cracking FCC reactor 4. Hot regenerated catalyst is added via standpipe 102 and control valve 104 to mix with the feed. Preferably, some atomizing steam is added via line 141 to the base of the riser, usually with the feed. With heavier feeds, e.g. , a resid, 2–10 wt.% steam may be used. A hydrocarbon-catalyst mixture rises as a generally dilute phase through riser 4. Cracked products and coked catalyst are discharged via riser effluent conduit 6 into first stage cyclone 8 in vessel 2. The riser top temperature, the temperature in conduit 6, ranges between about 480 and 615° C. (900 and 1150° F.), and preferably between about 538 and 595° C. (1000 and 1050° F.). The riser top temperature is usually controlled by adjusting the catalyst to oil ratio in riser 4 or by varying feed preheat.

Cyclone 8 separates most of the catalyst from the cracked products and discharges this catalyst down via dipleg 12 to a stripping zone 30 located in a lower portion of vessel 2.* Vapor and minor amounts of catalyst exit cyclone 8 via gas effluent conduit 20 to second stage reactor cyclones 14. The second cyclones 14 recovers some additional catalyst which is discharged via diplegs to the stripping zone 30. *Stripping steam may be added via line 241.

The second stage cyclone overhead stream, cracked products and catalyst fines, passes via effluent conduit 16 and line 120 to product fractionators not shown in the figure. Stripping vapors enter the atmosphere of the vessel 2 and may exit this vessel via outlet line 22 or by passing through an annular opening in line 20, not shown, i.e. the inlet to the secondary cyclone can be flared to provide a loose slip fit for the outlet from the primary cyclone.

The coked catalyst discharged from the cyclone diplegs collects as a bed of catalyst 31 in the stripping zone 30. Dipleg 12 is sealed by being extended into the catalyst bed 31. The dipleg from the secondary cyclones 14 is sealed by a flapper valve, not shown.

Many cyclones, 4 to 8, are usually used in each cyclone separation stage. A preferred closed cyclone system is described in U.S. Pat. No. 4,502,947 to Haddad et al, which is incorporated by reference.

The FCC reactor system described above is conventional and forms no part of the present invention.

Stripper 30 is a "hot stripper." Hot stripping is preferred, but not essential. Spent catalyst is mixed in bed 31 with hot catalyst from the regenerator. Direct contact heat exchange heats spent catalyst. The regenerated catalyst, which has a temperature from 55° C. (100° F.) above the stripping zone 30 to 871° C. (1600° F.), heats spent catalyst in bed 31. Catalyst from regenerator 80 enters vessel 2 via transfer line 106, and slide valve 108 which controls catalyst flow. Adding hot, regenerated catalyst permits first stage stripping at from 55° C. (100° F.) above the riser reactor outlet temperature and 816° C. (1500° F.). Preferably, the first stage stripping zone operates at least 83° C. (150° F.) above the riser top temperature, but below 760° C. (1400° F.).

In bed 31 a stripping gas, preferably steam, flows countercurrent to the catalyst. The stripping gas is preferably introduced into the lower portion of bed 31 by one or more conduits 341. The stripping zone bed 31 preferably contains trays or baffles not shown.

High temperature stripping removes coke, sulfur and hydrogen from the spent catalyst. Coke is removed because carbon in the unstripped hydrocarbons is burned as coke in the regenerator. The sulfur is removed as hydrogen sulfide and mercaptans. The hydrogen is removed as molecular hydrogen, hydrocarbons, and hydrogen sulfide. The removed materials also increase the recovery of valuable liquid products, because the stripper vapors can be sent to product recovery with the bulk of the cracked products from the riser reactor. High temperature stripping can reduce coke load to the regenerator by 30 to 50% or more and remove 50%–80% of the hydrogen as molecular hydrogen, light hydrocarbons and other hydrogen-containing compounds, and remove 35 to 55% of the sulfur as hydrogen sulfide and mercaptans, as well as a portion of nitrogen as ammonia and cyanides.

Although a hot stripping zone is shown in FIG. 1, the present invention is not, per se, the hot stripper. The process of the present invention may also be used with conventional strippers, or with long residence time steam strippers, or with strippers having internal or external heat exchange means.

Although not shown in FIG. 1, an internal or external catalyst stripper/cooler, with inlets for hot catalyst and fluidization gas, and outlets for cooled catalyst and stripper vapor, may also be used where desired to cool catalyst stripped catalyst before it enters the regenerator. Although much of the regenerator is conventional (the coke combustor, dilute phase transport riser and second dense bed) several significant departures from conventional operation occur.

The FCC catalyst is regenerated in two stages, i.e., both in the coke combustor/transport riser and in the second fluidized bed, which is preferably a dense bed or bubbling fluidized bed. Partial CO combustion is maintained in both the first and second stage of catalyst regeneration, and reliably controlled in a way that accommodates changes in unit operation.

In the FIG. 1 embodiment, the first stage air addition rate, or air to the riser mixer 60 and coke combustor 62, is held relatively constant, while the air addition to the second stage of regeneration, second fluidized bed 82, is controlled based on the CO content of the flue gas in the second stage.

The stripped catalyst passes through the conduit 42 into regenerator riser 60. Air from line 66 and stripped catalyst combine and pass up through an air catalyst disperser 74 into coke combustor 62 in regenerator 80. In bed 62, combustible materials, such as coke on the catalyst, are burned by contact with air or oxygen containing gas.

The amount of air or oxygen containing gas added via line 66, to the base of the riser mixer 60, is preferably constant and preferably restricted to 10%-95% of total air addition to the first stage of regeneration. Additional air, preferably 5%-50% of total air, is added to the coke combustor via line 160 and air ring 167. In this way the first stage of regeneration in regenerator 80 can be done with as much air as desired, but the air addition rate to the first stage should be relatively constant. The partitioning of the first stage air, between the riser mixer 60 and the air ring 167 in the coke combustor, can be fixed or controlled by a differential temperature, e.g., temperature rise in riser mixer 60. The total amount of air addition to the first stage, i.e., the regeneration in the coke combustor and riser mixer preferably is constant and usually will be large enough to remove most of the coke on the catalyst, preferably at least 60% and most preferably at least 75%.

The temperature of fast fluidized bed 76 in the coke combustor 62 may be, and preferably is, increased by recycling some hot regenerated catalyst thereto via line 101 and control valve 103. If temperatures in the coke combustor are too high, some heat can be removed via catalyst cooler 48, shown as tubes immersed in the fast fluidized bed in the coke combustor. Very efficient heat transfer can be achieved in the fast fluidized bed, so it may be beneficial to both heat the coke combustor (by recycling hot catalyst to it) and to cool the coke combustor (by using catalyst cooler 48) at the same time. Neither catalyst heating by recycle, nor catalyst cooling, by the use of a heat exchange means, per se form any part of the present invention.

In coke combustor 62 the combustion air, regardless of whether added via line 66 or 160, fluidizes the catalyst in bed 76, and subsequently transports the catalyst continuously as a dilute phase through the regenerator riser 83. The dilute phase passes upwardly through the riser 83, through riser outlet 306 into primary regenerator cyclone 308. Catalyst is discharged down through dipleg 84 to form a second relatively dense bed of catalyst 82 located within the regenerator 80.

While most of the catalyst passes down through the dipleg 84, the flue gas and some catalyst pass via outlet 310 into enlarged opening 324 of line 322. This ensures that most of the flue gas created in the coke combustor or dilute phase transport riser, and most of the water of combustion present in the flue gas, will be isolated from, and quickly removed from, the atmosphere of vessel 80. The flue gas from the regenerator riser cyclone gas outlet is almost immediately charged via lines 320 and 322 into the inlet of another cyclone separation stage, cyclone 86. An additional stage of separation of catalyst from flue gas is achieved, with catalyst recovered via dipleg 90 and flue gas discharged via gas exhaust line 88. Preferably flue gas is discharged to yet a third stage of cyclone separation, in third stage cyclone 92. Flue gas, with a greatly reduced solids content is discharged from the regenerator 80 and from cyclone 92 via exhaust line 94 and line 100.

The use of cyclones as shown in FIG. 1 to handle the flue gas is a preferred but not essential method of dealing with the flue gas streams from two stages of coke combustion. It is not essential to the practice of the present invention to have a cyclone on the transport riser outlet, nor to isolate flue gas from the first stage of combustion from the second stage of combustion.

The hot, regenerated catalyst discharged from the various cyclones forms a second fluidized bed 82, which is substantially hotter than any other place in the regenerator, and hotter than the stripping zone 30. Bed 82 is at least 55° C. (100° F.) hotter than stripping zone 31, and preferably at least 83° C. (150° F.) hotter. The regenerator temperature is, at most, 871° C. (1600° F.) to prevent deactivating the catalyst.

Controlled amounts of air are added via valve 72 and line 78 to dense bed 82. Dense bed 82 preferably contains significantly more catalyst inventory than has previously been used in high efficiency regenerators. Adding inventory and adding combustion air to second dense bed 82 shifts some of the coke combustion to the relatively dry atmosphere of dense bed 82, and minimizes hydrothermal degradation of catalyst. The additional inventory, and increased residence time, in bed 82 permit 5 to 70%, and preferably 10 to 60% and most preferably 15 to 50%, of the coke content on spent catalyst to be removed under relatively dry conditions, and under reducing conditions. This is a significant change from the way high efficiency regenerators have previously operated, with a limited catalyst inventory in the second dense bed 82, and highly oxidizing atmospheres throughout.

The air addition rate to the second dense bed, bed 82, is controlled to limit air addition so that there will never be enough air added to achieve complete CO combustion. In the FIG. 1 embodiment, flue gas analyzers such as CO analyzer controller 625 and probe 610 monitor composition of vapor in the dilute phase region above second dense bed 82, and can maintain the desired amount of CO combustion. If the second stage gets behind in coke burning, the CO content of the flu gas will increase causing controller 625 to signal, via signal transmission means 615, valve open and admit more air to burn more CO to CO2, a reduce the CO content of the flue gas.

Measurement of CO content of the flue gas, O2 content of the flue gas, or a ratio of CO/CO2 may also be used, all can be equivalent measures of flue gas content and indicate to some extent how much coke burning is occurring in the second dense bed. Similar information can be derived by measuring the amount of afterburning that occurs in the dilute phase, i.e., by measuring a delta T in the dilute phase, across a cyclone above the second dense bed, or a dT between the dense bed and a dilute phase or flue gas stream. In most units, dT control and measurement of, e.g., the CO content of the gas in the dilute phase will be equivalent, but this need not always be the case. A unit which is heavily promoted with Pt could operate with a great range of CO concentrations, all of which correspond to little or no free oxygen being present, and little or not afterburning. For those units which are intentionally or accidentally overpromoted, measurement of O2 content, or of a dT, will not provide a useful means of controlling the system.

Some fine tuning of the unit is both possible and beneficial. The amount of air added at each stage (riser mixer 60, coke combustor 62, transport riser 83, and second dense bed 82) is preferably set to maximize hydrogen combustion at the lowest possible temperature, and postpone as much carbon combustion until as late as possible, with highest temperatures reserved for the last stage of the process. In this way, most of the water of combustion, and most of the extremely high transient temperatures due to burning of poorly stripped hydrocarbon occur in riser mixer 60 where the catalyst is coolest. The steam formed will cause hydrothermal degradation of the zeolite, but the temperature will be so low that activity loss will be minimized. Shifting some of the coke burning to the second dense bed will limit the highest temperatures to the driest part of the regenerator. The water of combustion formed in the riser mixer, or in the coke combustor, will not contact catalyst in the second dense bed 82, because of the catalyst flue gas separation which occurs exiting the dilute phase transport riser 83.

Preferably, some hot regenerated catalyst is withdrawn from dense bed 82 and passed via line 106 and control valve 108 into dense bed of catalyst 31 in stripper 30. Hot regenerated catalyst passes through line 102 and catalyst flow control valve 104 for use in heating and cracking of fresh feed.

Some monitoring of the system will usually be needed, as is the case in most refinery processes. If a low coking feed is used, or if the feed rate to the unit is low, then essentially all of the coke will be burned in the first regeneration stage, and no combustion air will be needed in the second stage (fluffing air will still be needed). If this occurs, the unit will at first try to compensate as much as it can by reducing air to the second stage of the regenerator. If the operator observes that only minimum air (fluffing air) is being added to the second stage, it means that the primary air rate (lines 66 and 160) should be reduced to shift some of the burning to the second stage. The opposite situation can also occur, i.e., if more feed or a high CCR feed must be processed, such that the CO content of the flue gas above the second dense bed increases, despite maximum addition of air via line 78. In this case, the fixed amount of air added to the first regeneration stage should be increased.

Partial CO combustion is easy to achieve in the riser mixer or the coke combustor. This is because there will always be large amounts of coke on catalyst exiting the riser. Combustion air to the second stage can be set to maintain, e.g., 4, 5, 7 or 10 mole % CO in flue gas.

A roughly equivalent control scheme, not shown in FIG. 1, is to maintain constant the amount of air added to the second stage, and let the second stage CO content control the amount of air added to the first stage.

If the CO content of the second stage flue gas goes up to, e.g., 5, 6 or 8 mole % CO, in response to a major change in feed characteristics or operating conditions, it may be beneficial to manually increase the combustion air to the coke combustor, and reduce coke on catalyst entering the second stage.

If second stage flue gas CO content decreases, e.g., to 4.0 mole %, that means the second stage is not being worked hard enough, so the amount of air added to the first stage will be decreased to shift more of the coke burning load to the second stage of regeneration. In this way a relatively simple and reliable control scheme (use of a flue gas composition or delta T indicative of a composition of flue gas above the second fluidized bed) can accommodate normal minor changes in operation, and even be adjusted to deal with major changes in operation.

FIG. 2 Embodiment

Figure 2:
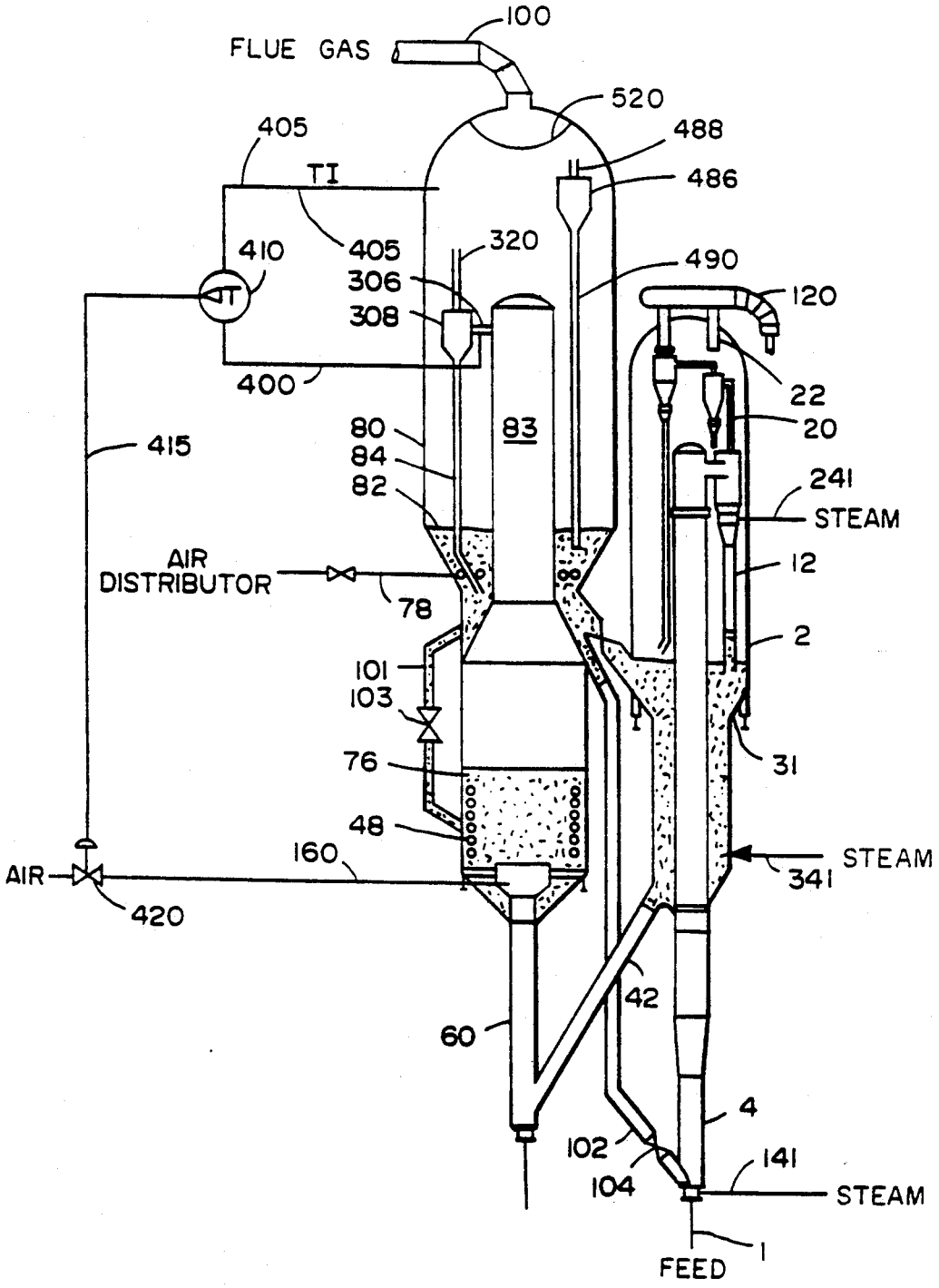
FIG. 2 is a simplified schematic view of an embodiment of the same regenerator wherein a delta T controller changes air addition to the coke combustor.

In the embodiment shown in FIG. 2, the two coke combustion zones (bed 62 and bed 82) operate independently, i.e., the flue gases from each stage of combustion are isolated. Such complete isolation will, however, usually not be necessary, as both flue gas streams have similar (reducing) atmospheres.

The FIG. 2 embodiment uses a different method of controlling air addition to the various stages of the regenerator, a delta T controller associated with the flue gas stream adjusts air flow to the coke combustor. This presents some special control problems, which will be briefly reviewed in a general way, then reviewed in conjunction with the FIG. 2 embodiment.

To control air addition to maintain partial CO combustion, in a high efficiency regenerator, a different approach is needed, as compared to conventional operation of such regenerators (a single stage of regeneration, with complete CO combustion) or conventional bubbling dense bed regenerators.

High efficiency regenerators almost always operate with some afterburning in the dilute phase transport riser, because the dilute phase conditions, and generally high temperatures promote CO afterburning. Thus there will always be afterburning. If partial CO combustion, and multistage regeneration of catalyst is the goal, there will always be carbon present, so additional coke combustion will usually occur to a limited extent in the transport riser. Conventional control approaches will not work well. There will always be a dT between the coke combustor and the top of the dilute phase transport riser. Such a dT is an indication of proper operation, not a sign that too much air is being added. It is essential to separate the bulk of the catalyst from the flue gas from the first regeneration stage before a dT signal can be developed which is meaningful.

In the FIG. 2 embodiment, the flue gases are isolated, but the catalyst streams are not. If the unit gets behind in coke combustion, the carbon level on catalyst in the second stage of regeneration, bubbling dense bed 82, will increase. This in turn will increase the carbon level, on average, in the coke combustor because of the recycle of hot "regenerated" catalyst from bed 82 to the coke combustor via line 101. The increased average carbon level on catalyst in the coke combustor will consume more of the combustion air added via line 160, reduce excess O2, and reduce afterburning downstream of cyclone 308, calling for an increase in the amount of air added to the coke combustor. In this way the FIG. 2 embodiment can respond to changes in a reliable and safe manner, although it may be difficult to see at first how the unit can operate at all. The operation of the control scheme will now be reviewed in the context of the operation of the FIG. 2 FCC regenerator.

Differential temperature controller 410 receives signals from thermocouples 400 and 405 or other temperature sensing means responding to temperatures in the inlet and vapor outlet of the cyclone 308 associated with the regenerator transport riser outlet. A change in temperature, delta T, indicates afterburning. An appropriate signal is then sent via control line 415 to alter air flow across valve 420 and regulate air addition to the coke combustor via line 160. The air flow via line 78 to the upper dense bed is fixed, i.e., a conventional control means admits a fixed volume of air or conventional means can be used to maintain partial CO combustion.

Partial CO combustion must be maintained in both combustion zones (#1 being the coke combustor and transport riser, #2 being the bubbling dense bed 82). This limits heat release in the regenerator, minimizes NOx emissions, and increases the coke burning capacity of the regenerator.

In FIG. 2, elements which correspond to elements in FIG. 1 have the same numbers, e.g., riser reactor 4 is the same in both figures. The reactor section, stripping section, riser mixer, coke combustor and transport riser are essentially the same in both figures. The differences relate to isolation of the various flue gas streams from the regenerator and the way that addition of air to the various zones is controlled.

Flue gas and catalyst discharged from the FIG. 2 transport riser are charged via line 306 to a cyclone separator 308. Catalyst is discharged down via dipleg 84 to second dense bed 82. Flue gas, and water of combustion present in the flue gas, are removed from cyclone 308 via line 320 and charged to a secondary cyclone 486 for another stage of separation of catalyst from flue gas. Catalyst recovered in this second stage of cyclone separation is discharged via dipleg 490, which is sealed by immersion in second dense bed 82. The cyclone dipleg could also be sealed with a flapper valve. Flue gas from the second stage cyclone 486 is removed from the containment vessel via line 488. Both cyclones 308 and 486 are isolated from the gas environment within vessel 80.

Flue gas is also generated by coke combustion in second fluidized bed 82. This flue gas will be very hot and very dry. It will be hot because the second dense bed is usually the hottest place in a high efficiency regenerator. It will be dry because all of the "fast coke" or hydrogen content of the coke is burned from the catalyst upstream of the second dense bed. Much and perhaps most of the hydrogen burns in the riser mixer. Such hydrogen as survives the riser mixer is essentially completely burned passing through the coke combustor and the dilute phase transport riser. The coke surviving to exit the transport riser outlet will have an exceedingly low hydrogen content, less than 5%, and frequency less than 2% or even 1%. This coke can be burned in the second dense bed to form either CO2 or a mixture of CO and CO2, but there will be very little water formed in the burning of this coke. Thus the flue gas from coke combustion in bed 82 is different, and is handled differently, from flue gas exiting the transport riser.

The hot dry flue gas produced by coke combustion in bed 82 usually has a much lower fines/catalyst content than flue gas from the transport riser. This is because the superficial vapor velocity in bubbling dense bed 82 is much less than the vapor velocity in the fast fluidized bed coke combustor. The coke combustor and transport riser work effectively because all of the catalyst is entrained out of them, while the second dense bed works best when none of the catalyst is carried into the dilute phase. This reduced vapor velocity in the second dense bed permits use of a single stage cyclone 486 to recover entrained catalyst from dry flue gas. The catalyst recovered is discharged down via dipleg 490 to return to the second dense bed. The hot, dry flue gas is discharged via cyclone outlet 488 which connects with plenum inlet 520 and vessel outlet 100.

If the two flue gas stream are isolated, greater tolerance for upsets, without burning down the unit, is possible. If in one stage an oxidizing atmosphere is produced inadvertently, this need not lead to massive afterburning, which would occur if a hot O2 rich flue gas stream mixed with a hot CO rich flue gas stream.

The coke combustor is run in partial CO combustion mode to minimize heat release and temperature rise in the relatively high steam pressure atmosphere of the coke combustor, and to minimize NOx emissions. Final cleanup of the catalyst occurs in the second dense bed, also operating in partial CO combustion, to achieve fairly clean regenerated catalyst.

The FIG. 1 and 2 embodiments provide a reliable, straightforward way to run the unit while maintaining partial CO combustion in both the first and second stage of the regenerator.

The FIG. 1 embodiment, by maintaining relatively constant air rates to the first regeneration stage, does not significantly alter operation/entrainment characteristics of the coke combustor or transport riser. Entrainment, catalyst holdup in the coke combustor, all remain constant.

The FIG. 2 embodiment uses conventional thermocouples and dT controllers, which have been used for decades to control air flow to bubbling dense bed regenerators. The FIG. 2 embodiment does not allow as much flexibility as desired, and in particular, does not lend itself to maximizing coke burning in the dry atmosphere of the second dense bed. It also alters the air flow to the coke combustor, and may cause significant changes in catalyst residence time in the coke combustor and catalyst entrainment in the transport riser.

The FIG. 2 embodiment can also be practiced using a flue gas analyzer associated with the flue gas above the second dense bed, or bubbling dense bed, to generate a control signal to adjust primary air flow. This works very much like use of dT to control air flow, but can be fooled by the presence of too much Pt CO combustion promoter. This means that with large amounts of Pt present, it is possible to always operate with little or no excess air, as evidence by % O2 in the flue gas, regardless of how much air is added, until the unit operation shifts to complete CO combustion. In this instance, measurement of CO content of the flue gas is a better way to control primary air flow, rather than measurement of % O2 in the flue gas.

Figure 3:
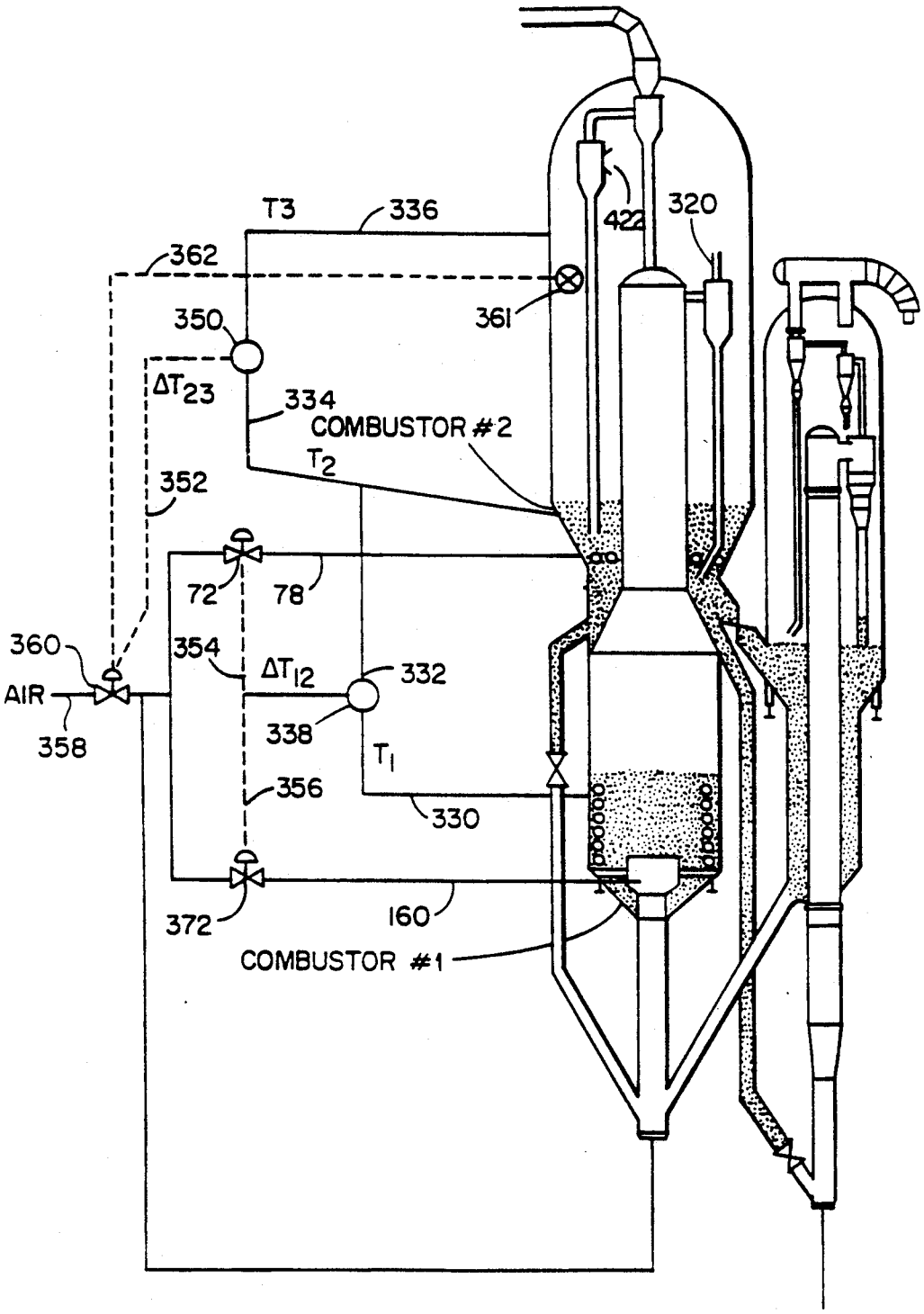
FIG. 3 is a simplified schematic view of an embodiment of the same regenerator using a flue gas analyzer, or a delta T controller to shift air addition between the coke combustor and the second fluidized bed.

It would be beneficial if the relatively amount of coke burning in the primary and secondary stage of the regenerator could be directly controlled. Some units tolerate swings in coke production if, e.g., roughly half of the carbon is burned in the first stage, and the remaining half burned in the second stage, regardless of swings in coke make. FIG. 3 provides a way to apportion and control the relative amount of coke burning that occurs in each stage of regeneration.

The FIG. 3 embodiment uses most of the hardware from the FIG. 1 embodiment, i.e., the regenerator flue gas streams are combined in cyclone inlet 422 into a single flue gas stream. The difference in the FIG. 3 embodiment is simultaneous adjustment of both primary and secondary air. This can be seen more easily in conjunction with a review of the Figure. Elements which correspond to FIG. 1 element have the same reference numerals, and are not discussed. FIG. 3 includes, besides reference numerals, symbols indicating temperature differences, e.g., $dT_{12}$ means that a signal is developed indicative of the temperature difference between two indicated temperatures, temperature 1 and temperature 2.

The amount of air added to the riser mixer is fixed, for simplicity, but this is merely to simplify the following analysis. The riser mixer air is merely part of the primary air, and could vary with any variations in flow of air to the coke combustor. It is also possible to operate the regenerator with no riser mixer at all, in which case spent catalyst, recycled regenerated catalyst, and primary air are all added directly to the coke combustor. The riser mixer is preferred.

The control scheme will first be stated in general terms, then reviewed in conjunction with FIG. 3. The overall amount of combustion air, i.e., the total air to the regenerator, is controlled based on either a composition of the flue gas or a differential temperature associated with the second dense bed. As far as overall control, considering the regenerator as a single stage, this is similar to what happens in conventional bubbling dense bed regenerators, i.e., air flow is controlled to maintain a small amount of afterburning, usually by dT, or by composition.

Controlling the second stage flue gas composition (either directly using an analyzer or indirectly using delta T to show afterburning) by apportioning the air added to each combustion zone allows unit operation to be optimized even when the operator does not know the individual optima for the first and second stages. If the second fluidized bed, typical a bubbling dense bed with fairly poor contacting efficiency, is being called on to do too much, lots of afterburning, and an increased dT in the flue gas, will occur. The unit can be controlled by increasing the air rate to the coke combustor and decreasing air flow to the second dense bed.

In the FIG. 3 embodiment, the control scheme apportions air between the first and second stages of the regenerator. This is a more complicated control method that was used in FIG. 1 or 2, but will usually allow better operation. An operator may specify e.g., that 40% of the coke will be burned in the first stage and 60% burned in the second stage, regardless of fluctuations in coke make. Several control loops are needed, basically at least one loop to control total air addition to the regenerator based on a measurement of the flue gas from the unit, and one loop to shift air between the first and second stage to keep the relative amounts of coke combustion in each stage constant. The control method can best be understood in conjunction with a review of the Figure.

The total air flow, in line 358 is controlled by means of a flue gas analyzer 361 and transmission means 362 or preferably by dT controller 350 which measures and controls the amount of afterburning above the second dense bed. The bubbling dense bed temperature (T2) is sensed by thermocouple 334, and the dilute phase temperature (T3) is monitored by thermocouple 336. These signals are the input to differential temperature controller 350, which generates a control signal based on dt23, or the difference in temperature between the bubbling dense bed (T2) and the dilute phase above the dense bed (T3). The control signal is transmitted via transmission means 352 (an air line, or a digital or analog electrical signal or equivalent signal transmission means) to valve 360 which regulates the total air flow to the regenerator via line 358.

The apportionment of air between the primary and secondary stages of regeneration is controlled by the differences in temperature of the two relatively dense phase beds in the regenerator. The temperature (T1) in the coke combustor fast fluidized bed is determined by thermocouple 330. The bubbling dense bed temperature (T2) is determined by thermocouple 334 and sent by signal splitting means 332 to differential temperature controller 338, which generates a signal based on dT12, or the difference in temperature between the two beds. Signals are sent via means 356 to valve 372 (primary air to the coke combustor) and via means 354 to valve 72 (secondary air to bubbling dense bed).

If the delta T (dT12) becomes too large, it means that not enough coke burning is taking place in the coke combustor, and too much coke burning occurs in the second dense bed. The dT controller 338 will compensate by sending more combustion air to the coke combustor, and less to the bubbling dense bed.

There are several other temperature control points which can be used besides the ones shown. The operation of the coke combustor can be measured by a fast fluidized bed temperature (as shown), by a temperature in the dilute phase of the coke combustor or in the dilute phase transport riser, a temperature measured in the primary cyclone or on a flue gas stream or catalyst stream discharged from the primary cyclone. A flue gas or catalyst composition measurement can also be used to generate a signal indicative of the amount of coke combustion occurring in the fast fluidized bed, but this will generally not be as sensitive as simply measuring the bed temperature in the coke combustor.

It should also be emphasized that the designations "primary air" and "secondary air" do not require that a majority of the coke combustion take place in the coke combustor. In most instances, the fast fluidized bed region will be the most efficient place to burn coke, but there are considerations, such as reduced steaming of catalyst if regenerated in the bubbling dense bed, and reduced thermal deactivation of catalyst by delaying as long as possible as much of the carbon burning as possible, which may make it beneficial to burn most of the coke with the "secondary air".

It is possible to magnify or to depress the difference in temperature between the coke combustor and the bubbling dense bed by changing the amount of hot regenerated catalyst which is recycled. Operation with large amounts of recycle, i.e., recycling more than 1 or 2 weights of catalyst from the bubbling dense bed per weight of spent catalyst, will depress temperature differences between the two regions. Differential temperature control can still be used, but the gain and/or setpoint on the controller may have to be adjusted because recycle of large amounts of catalyst from the second dense bed will increase the temperature in the fast fluidized bed coke combustor.

Figure 4:
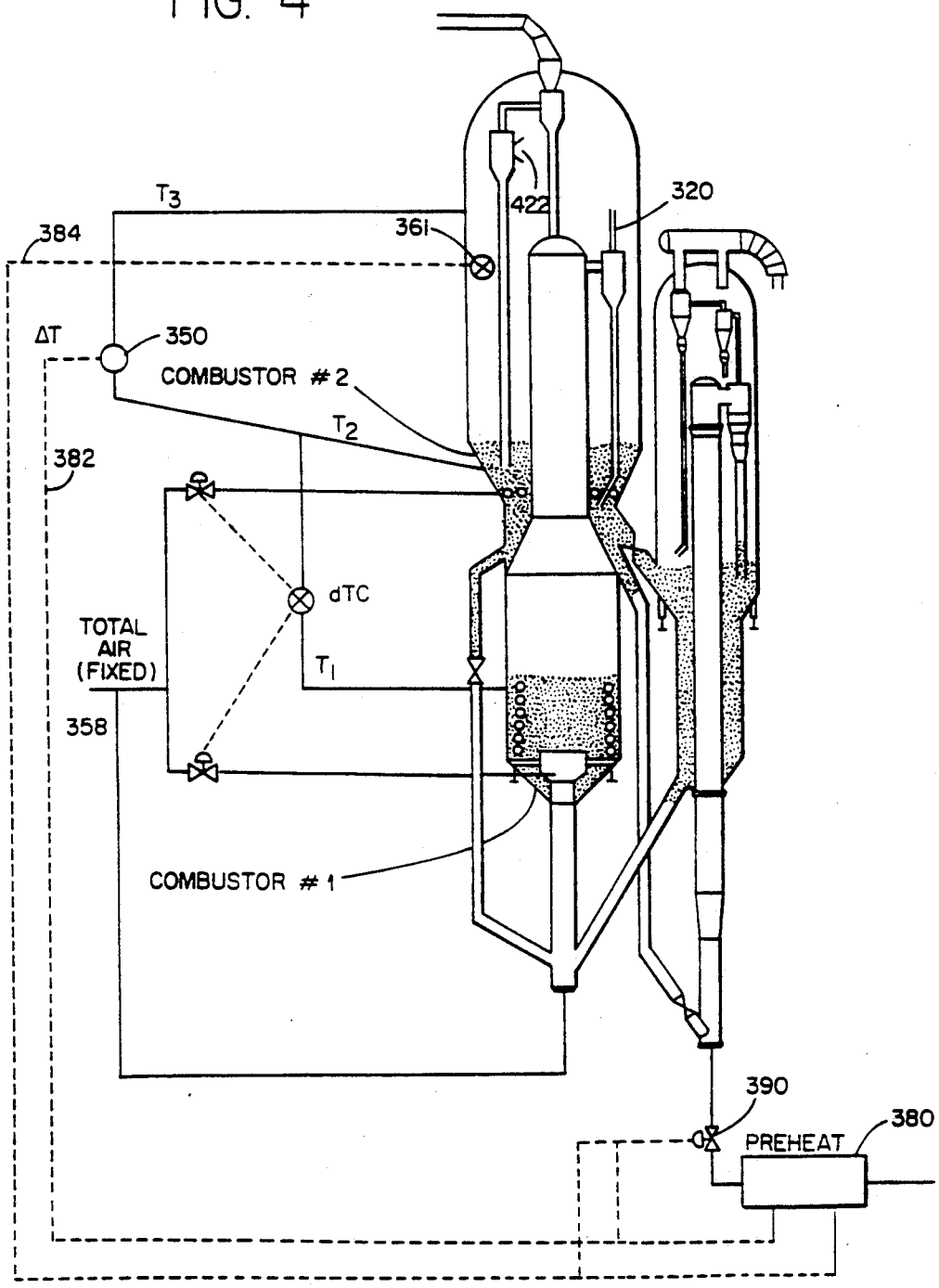
FIG. 4 shows the same regenerator wherein a flue gas analyzer controller, and/or a delta T controller, changes feed preheat and/or feed rate.

The control method of FIG. 3 will be preferred for most refineries. Another method of control is shown in FIG. 4, which can be used as an alternative to the FIG. 3 method. The FIG. 4 control method retains the ability to apportion combustion air between the primary and secondary stages of regeneration, but adjusts feed preheat, and/or feed rate, rather than total combustion air, to maintain partial CO combustion. The FIG. 4 control method is especially useful where a refiner's air blower capacity is limiting the throughput of the FCC unit. Leaving the air blower at maximum, and adjusting feed preheat and/or feed rate, will maximize the coke burning capacity of the unit by always running the air blower at maximum throughput, minimize somewhat the amount of combustion air required (by limiting the unit to partial CO combustion a slight decrease in regeneration air requirement may be achieved) and minimize heat generation in the regenerator.

In the FIG. 4 embodiment, the total amount of air added via line 358 is controlled solely by the capacity of the compressor or air blower. The apportionment of air between primary and secondary stages of combustion is controlled as in the FIG. 3 embodiment. The feed preheat and/or feed rate are adjusted as necessary to maintain partial CO combustion in both stages. Each variable changes the coke make of the unit, and each will be reviewed in more detail below.

Feed preheat can control afterburning because of the way FCC reactors are run. The FCC reactor usually operates with a controlled riser top temperature. The hydrocarbon feed in line 1 is mixed with sufficient hot, regenerated catalyst from line 102 to maintain a given riser top temperature. This is the way most FCC units operate. The temperature can be measured at other places in the reactor, as in the middle of the riser, at the riser outlet, cracked product outlet, or a spent catalyst temperature before or after stripping, but usually the riser top temperature is used to control the amount of catalyst added to the base of the riser to crack fresh feed. If the feed is preheated to a very high temperature, and much or all of the feed is added as a vapor, less catalyst will be needed as compared to operation with a relatively cold liquid feed which is vaporized by hot catalyst. High feed preheat reduces the amount of catalyst circulation needed to maintain a given riser top temperature, and this reduced catalyst circulation rate reduces coke make. A constant air supply and a reduced coke make, regardless of the reason for the reduction in coke make, will increase the O2 content of the flue gas.

If the O2 content of the flue gas above the bubbling dense bed increases (or if CO content drops) a composition based control signal from analyzer controller 361 may be sent via signal transmission means 384 to feed preheater 380 or to valve 390. Decreasing feed preheat, i.e., a cooler feed, increases coke make. Increasing feed rate increases coke make. Either action, or both together, will increase the coke make, and bring flue gas composition back to the desired point. A differential temperature control 350 may generate an analogous signal, transmitted via means 382 to adjust preheat and/or feed rate.

The FIG. 4 embodiment provides a good way to accommodate unusually bad feeds, with CCR levels exceeding 5 or 10 wt %. Partial CO combustion, with downstream combustion of CO, in a CO boiler, and constant maximum air rate maximize the coke burning capacity of the regenerator using an existing air blower of limited capacity.

Other Embodiments

A number of mechanical modifications may be made to the high efficiency regenerator without departing from the scope of the present invention. It is possible to use the control scheme of the present invention even when additional catalyst/flue gas separation means are present. As an example, the riser mixer 60 may discharge into a cyclone or other separation means contained within the coke combustor. The resulting flue gas may be separately withdrawn from the unit, without entering the dilute phase transport riser. Such a regenerator configuration is shown in EP A 0259115, published on Mar. 9, 1988 and in U.S. Ser. No. 188,810 which is incorporated herein by reference.

Now that the invention has been reviewed in connection with the embodiments shown in the Figures, a more detailed discussion of the different parts of the process and apparatus of the present invention follows. Many elements of the present invention can be conventional, such as the cracking catalyst, or are readily available from vendors, so only a limited discussion of such elements is necessary.

FCC Feed

Any conventional FCC feed can be used. The process of the present invention is especially useful for processing difficult charge stocks, those with high levels of CCR material, exceeding 2, 3, 5 and even 10 wt % CCR. The process tolerates feeds which are relatively high in nitrogen content, and which otherwise might produce unacceptable NOx emissions in conventional FCC units, operating with complete CO combustion.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The present invention is most useful with feeds having an initial boiling point above about 650° F.

FCC Catalyst

Any commercially available FCC catalyst may be used. The catalyst can be 100% amorphous, but preferably includes some zeolite in a porous refractory matrix such as silica-alumina, clay, or the like. The zeolite is usually 5–40 wt. % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

Relatively high silica zeolite containing catalysts are preferred for use in the present invention. They withstand the high temperatures usually associated with complete combustion of CO to CO2 within the FCC regenerator.

The catalyst inventory may also contain one or more additives, either present as separate additive particles or mixed in with each particle of the cracking catalyst. Additives can be added to enhance octane (shape selective zeolites, i.e., those having a Constraint Index of 1–12, and typified by ZSM-5, and other materials having a similar crystal structure), adsorb SOX (alumina), remove Ni and V (Mg and Ca oxides).

Additives for removal of SOx are available from catalyst suppliers, such as Davison's "R" or Katalistiks International, Inc.'s "DeSox."

CO combustion additives are available from most FCC catalyst vendors.

The FCC catalyst composition, per se, forms no part of the present invention.

FCC Reactor Conditions

Conventional FCC reactor conditions may be used. The reactor may be either a riser cracking unit or dense bed unit or both. Riser cracking is highly preferred. Typical riser cracking reaction conditions include catalyst/oil ratios of 0.5:1 to 15:1 and preferably 3:1 to 8:1, and a catalyst contact time of 0.5-50 seconds, and preferably 1-20 seconds.

It is preferred, but not essential, to use an atomizing feed mixing nozzle in the base of the riser reactor, such as ones available from Bete Fog. More details of use of such a nozzle in FCC processing are disclosed in U.S. Ser. No. 424,420, which is incorporated herein by reference.

It is preferred, but not essential, to have a riser acceleration zone in the base of the riser, as shown in FIGS. 1 and 2.

It is preferred, but not essential, to have the riser reactor discharge into a closed cyclone system for rapid and efficient separation of cracked products from spent catalyst. A preferred closed cyclone system is disclosed in U.S. Pat. No. 4,502,947 to Haddad et al.

It is preferred but not essential, to rapidly strip the catalyst, immediately after it exits the riser, and upstream of the conventional catalyst stripper. Stripper cyclones disclosed in U.S. Pat. No. 4,173,527, Schatz and Heffley, may be used.

It is preferred, but not essential, to use a hot catalyst stripper. Hot strippers heat spent catalyst by adding some hot, regenerated catalyst to spent catalyst. The hot stripper reduces the hydrogen content of the spent catalyst sent to the regenerator and reduces the coke content as well. Thus, the hot stripper helps control the temperature and amount of hydrothermal deactivation of catalyst in the regenerator. A good hot stripper design is shown in U.S. Pat. No. 4,820,404 Owen, which is incorporated herein by reference. A catalyst cooler cools the heated catalyst before it is sent to the catalyst regenerator.

The FCC reactor and stripper conditions, per se, can be conventional and form no part of the present invention.

Catalyst Regeneration

The process and apparatus of the present invention can use many conventional elements most of which are conventional in FCC regenerators.

The present invention uses as its starting point a high efficiency regenerator such as is shown in the Figures, or as shown. The essential elements include a coke combustor, a dilute phase transport riser and a second fluidized bed, which is usually a bubbling dense bed. The second fluidized bed can also be a turbulent fluidized bed, or even another fast fluidized bed, but unit modifications will then frequently be required. Preferably, a riser mixer is used. These elements are generally known.

Preferably there is quick separation of catalyst from steam laden flue gas exiting the regenerator transport riser. A significantly increased catalyst inventory in the second fluidized bed of the regenerator, and means for adding a significant amount of combustion air for coke combustion in the second fluidized bed are preferably present or added.

Each part of the regenerator will be briefly reviewed below, starting with the riser mixer and ending with the regenerator flue gas cyclones.

Spent catalyst and some combustion air are charged to the riser mixer 60. Some regenerated catalyst, recycled through the catalyst stripper, will usually be mixed in with the spent catalyst. Some regenerated catalyst may also be directly recycled to the base of the riser mixer 60, either directly or, preferably, after passing through a catalyst cooler. Riser mixer 60 is a preferred way to get the regeneration started. The riser mixer typically burns most of the fast coke (probably representing entrained or adsorbed hydrocarbons) and a very small amount of the hard coke. The residence time in the riser mixer is usually very short. The amount of hydrogen and carbon removed, and the reaction conditions needed to achieve this removal are reported below.

RISER MIXER CONDITIONS

| | Good | Preferred | Best |
|---|---|---|---|
| Inlet Temp. °F. | 900-1200 | 925-1100 | 950-1050 |
| Temp. Increase, F. | 10-200 | 25-150 | 50-100 |
| Catalyst Residence Time, Seconds | 0.5-30 | 1-25 | 1.5-20 |
| Vapor velocity, fps | 5-100 | 7-50 | 10-25 |
| % total air added | 1-25 | 2-20 | 3-15 |
| H2 Removal, % | 10-40 | 12-35 | 15-30 |
| Carbon Removal, % | 1-10 | 2-8 | 3-7 |

Although operation with a riser mixer is preferred, it is not essential, and in many units is difficult to implement because there is not enough elevation under the coke combustor in which to fit a riser mixer. Spent, stripped catalyst may be added directly to the coke combustor, discussed next.

The coke combustor 62 contains a fast fluidized dense bed of catalyst. It is characterized by relatively high superficial vapor velocity, vigorous fluidization, and a relatively low density dense phase fluidized bed. Most of the coke can be burned in the coke combustor. The coke combustor will also efficiently burn "fast coke", primarily unstripped hydrocarbons, on spent catalyst. When a riser mixer is used, a large portion, perhaps most, of the "fast coke" will be removed upstream of the coke combustor. If no riser mixer is used, relatively easy job of burning the fast coke will be done in the coke combustor.

The removal of hydrogen and carbon achieved in the coke combustor alone (when no riser mixer is used) or in the combination of the coke combustor and riser mixer, is presented below. The operation of the riser mixer and coke combustor can be combined in this way, because what is important is that catalyst leaving the coke combustor have specified amounts of carbon and hydrogen removed.

COKE COMBUSTOR CONDITIONS

| | Good | Preferred | Best |
|---|---|---|---|
| Dense Bed Temp. °F. | 900-1300 | 925-1275 | 950-1250 |
| Catalyst Residence Time, Seconds | 10-500 | 20-240 | 30-180 |
| Vapor velocity, fps | 1-40 | 2-20 | 3.5-15 |
| % total air added | 40-100 | 50-98 | 60-95 |
| H2 Removal, % | 40-100 | 50-98 | 70-95 |
| Carbon Removal, % | 30-100 | 40-95 | 50-90 |

The dilute phase transport riser 83 forms a dilute phase where efficient afterburning of CO to CO2 can occur, or as practiced herein, when CO combustion is constrained, efficiently transfers catalyst from the fast fluidized bed through a catalyst separation means to the second dense bed.

Additional air can be added to the dilute phase transport riser, but usually it is better to add the air lower down in the regenerator, and speed up coke burning rates some.

| TRANSPORT RISER CONDITIONS | | | |
|---|---|---|---|
| | Good | Preferred | Best |
| Inlet Temp. °F. | 900-1300 | 925-1275 | 950-1250 |
| Outlet Temp. °F. | 925-1450 | 975-1400 | 1000-1350 |
| Catalyst Residence Time, Seconds | 1-60 | 2-40 | 3-30 |
| Vapor velocity, fps | 6-50 | 9-40 | 10-30 |
| % additional air in | 0-40 | 0-10 | 0-5 |
| H2 Removal, % | 0-25 | 1-15 | 2-10 |
| Carbon Removal, % | 0-15 | 1-10 | 2-5 |

Quick and effective separation of catalyst from flue gas exiting the dilute phase transport riser is not essential but is very beneficial for the process. The rapid separation of catalyst from flue gas in the dilute phase mixture exiting the transport riser removes the water laden flue gas from the catalyst upstream of the second fluidized bed.

Multistage regeneration can be achieved in older high efficiency regenerators which do not have a very efficient means of separating flue gas from catalyst exiting the dilute phase transport riser. Even in these older units a reasonably efficient multistage regeneration of catalyst can be achieved by reducing the air added to the coke combustor and increasing the air added to the second fluidized bed. The reduced vapor velocity in the transport riser, and increased vapor velocity immediately above the second fluidized bed, will more or less segregate the flue gas from the transport riser from the flue gas from the second fluidized bed.

Rapid separation of flue gas from catalyst exiting the dilute phase transport riser is still the preferred way to operate the unit. This flue gas stream contains a fairly large amount of steam, from adsorbed stripping steam entrained with the spent catalyst and from water of combustion. Many FCC regenerators operate with 5-10 psia steam partial pressure in the flue gas. In the process and apparatus of one embodiment of the present invention, the dilute phase mixture is quickly separated into a catalyst rich dense phase and a catalyst lean dilute phase.

The quick separation of catalyst and flue gas sought in the regenerator transport riser outlet is very similar to the quick separation of catalyst and cracked products sought in the riser reactor outlet.

The most preferred separation system is discharge of the regenerator transport riser dilute phase into a closed cyclone system such as that disclosed in U.S. Pat. No. 4,502,947. Such a system rapidly and effectively separates catalyst from steam laden flue gas and isolates and removes the flue gas from the regenerator vessel. This means that catalyst in the regenerator downstream of the transport riser outlet will be in a relatively steam free atmosphere, and the catalyst will not deactivate as quickly as in prior art units.

Other methods of affecting a rapid separation of catalyst from steam laden flue gas may also be used, but most of these will not work as well as the use of closed cyclones. Acceptable separation means include a capped riser outlet discharging catalyst down through an annular space defined by the riser top and a covering cap.

In a preferred embodiment, the transport riser outlet may be capped with radial arms, not shown, which direct the bulk of the catalyst into large diplegs leading down into the second fluidized bed of catalyst in the regenerator. Such a regenerator riser outlet is disclosed in U.S. Pat. No. 4,810,360, which is incorporated herein by reference.

The embodiment shown in FIG. 1 is highly preferred because it is efficient both in separation of catalyst from flue gas and in isolating flue gas from further contact with catalyst. Well designed cyclones can recover in excess of 95, and even in excess of 98% of the catalyst exiting the transport riser. By closing the cyclones, well over 95%, and even more than 98% of the steam laden flue gas exiting the transport riser can be removed without entering the second fluidized bed. The other separation/isolation means discussed about generally have somewhat lower efficiency.

Regardless of the method chosen, at least 90% of the catalyst discharged from the transport riser preferably is quickly discharged into a second fluidized bed, discussed below. At least 90% of the flue gas exiting the transport riser should be removed from the vessel without further contact with catalyst. This can be achieved to some extent by proper selection of bed geometry in the second fluidized bed, i.e., use of a relatively tall but thin containment vessel 80, and careful control of fluidizing conditions in the second fluidized bed.

The second fluidized bed achieves a second stage of regeneration of the catalyst, in a relatively dry atmosphere. The multistage regeneration of catalyst is beneficial from a temperature standpoint alone, i.e., it keeps the average catalyst temperature lower than the last stage temperature. This can be true even when the temperature of regenerated catalyst is exactly the same as in prior art units, because when staged regeneration is used the catalyst does not reach the highest temperature until the last stage. The hot catalyst has a relatively lower residence time at the highest temperature, in a multistage regeneration process.

The second fluidized bed bears a superficial resemblance to the second dense bed used in prior art, high efficiency regenerators. There are several important differences which bring about profound changes in the function of the second fluidized bed.

In prior art second dense beds, the catalyst was merely collected and recycled (to the reactor and frequently to the coke combustor). Catalyst temperatures were typically 1250-1350° F., with some operating slightly hotter, perhaps approaching 1400° F. The average residence time of catalyst was usually 60 seconds or less. A small amount of air, typically around 1 or 2% of the total air added to the regenerator, was added to the dense bed to keep it fluidized and enable it to flow into collectors for recycle to the reactor. The superficial gas velocity in the bed was typically less than 0.5 fps, usually 0.1 fps. The bed was relatively dense, bordering on incipient fluidization. This was efficient use of the second dense bed as a catalyst collector, but meant that little or no regeneration of catalyst was achieved in the second dense bed. Because of the low vapor velocity in the bed, very poor use would be made of even the small amounts of oxygen added to the bed. Large fluidized beds such as this are characterized, or plagued, by generally poor fluidization, and relatively large gas bubbles.

In our process, we make the second fluidized bed do much more work towards regenerating the catalyst. The first step is to provide substantially more residence time in the second fluidized bed. We must have at least 1 minute, and preferably have a much longer residence time. This increased residence time can be achieved by adding more catalyst to the unit, and letting it accumulate in the second fluidized bed.

Much more air is added to our fluidized bed, for several reasons. First, we are doing quite a lot of carbon burning in the second fluidized bed, so the air is needed for combustion. Second, we need to improve the fluidization in the second fluidized bed, and much higher superficial vapor velocities are necessary. We also decrease, to some extent, the density of the catalyst in the second fluidized bed. This reduced density is a characteristic of better fluidization, and also somewhat beneficial in that although our bed may be twice as high as a bed of the prior art it will not have to contain twice as much catalyst.

Because so much more air is added in our process, we prefer to retain the old fluffing or fluidization rings customarily used in such units, and add an additional air distributor or air ring alongside of, or above, the old fluffing ring.

SECOND FLUIDIZED BED CONDITIONS

| | Good | Preferred | Best |
|---|---|---|---|
| Temperature °F. | 1200-1700 | 1300-1600 | 1350-1500 |
| Catalyst Residence Time, Seconds | 30-500 | 45-200 | 60-180 |
| Vapor velocity, fps | 0.5-5 | 1-4 | 1.5-3.5 |
| % total air added | 0-90 | 2-60 | 5-40 |
| H2 Removal, % | 0-25 | 1-10 | 1-5 |
| Carbon Removal, % | 10-70 | 5-60 | 10-40 |

Operating the second fluidized bed with more catalyst inventory, and higher superficial vapor velocity, allows an extra stage of catalyst regeneration, either to achieve cleaner catalyst or to more gently remove the carbon and thereby extend catalyst life. Enhanced stability is achieved because much of the regeneration, and much of the catalyst residence time in the regenerator, is under drier conditions than could be achieved in prior art designs.

CO COMBUSTION PROMOTER

Use of a CO combustion promoter in the regenerator or combustion zone is not essential for the practice of the present invention, however, it may be beneficial. These materials are well-known.

U.S. Pat. No. 4,072,600 and U.S. Pat. No. 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit. Pt can be replaced by other metals, but usually more metal is then required. An amount of promoter which would give a CO oxidation activity equal to 0.3 to 3 wt. ppm of platinum is preferred.

ILLUSTRATIVE EMBODIMENT

The process can be conducted using a 343 to 593° C. (650 to 1100° F.) boiling range feed charged to riser reactor 4 to mix with hot (about 760° C. (1400° F.)) regenerated catalyst and form a catalyst-hydrocarbon mixture. The mixture passes up through riser 4 into effluent conduit 6. The riser top temperature is about 538° C. (1000° F.). Spent catalyst discharged via cyclone diplegs collects a bed of catalyst 31. The hot stripping zone 30 operates at about 1050°-1150° F. Regenerated catalyst, added at a temperature of 1300°-1400° F., heats the stripping zone.

The well stripped catalyst, at a temperature of about 621° C. (1150° F.), combines with air from line 66 in riser mixer 60 to form an air-catalyst mixture. The mixture rises into the coke combustor fast fluid bed 76. Enough hot regenerated catalyst is added to the coke combustor, usually roughly equal to the amount of spent catalyst added to the coke combustor, to get the coke combustor hot enough for efficient carbon burning. The temperature of the coke combustor is usually around 950°-1250° F., because of recycle of hot regenerated catalyst, some preheating due to combustion in the riser mixer, and coke combustion in the coke combustor.

The catalyst and combustion air/flue gas mixture elutes up from fast fluid bed 76 through the dilute phase transport riser 83 and into a regenerator vessel 80. The catalyst exiting the riser 83 is separated from steam laden flue gas by closed cyclones 308. A catalyst rich phase passes down through the dipleg 84 to form a second fluidized bed 82. About 5% of the coke on the stripped catalyst burns in the conduit 60, about 55% is burned in the fast fluid bed 62, about 5% in the riser 83, and about 35% in the regenerator vessel 80. Due to the coke burning, the temperature of the catalyst increases as it passes through the unit. Air addition is controlled, using the control method shown in FIG. 4, to ensure partial CO combustion in both stages, and maximize the coke burning capacity of the unit.

DISCUSSION

When processing heavy, metals laden feeds in a regenerator of the invention, migration of vanadium, which is strongly influenced by steam partial pressure and temperature, will be greatly reduced.

NOx emissions are essentially eliminated. Minor amounts of NOx emissions may be generated during combustion of the CO containing flue gas in a CO boiler, but the bulk of the NOx emissions will be eliminated, even including those created by nitrogen fixation during combustion in the CO boiler. Most of the nitrogen compounds are burned at lower temperatures, and somewhat more reducing conditions than could be achieved in the prior art regeneration designs.

The control method of the present invention can be readily added to existing high efficiency regenerators. Most of the regenerator can be left untouched, as the modifications to install differential temperature probes in the regenerator cyclones, or flue gas analyzers, are minor. Usually only minor modifications will be needed in the second dense bed to accommodate the additional combustion air, and perhaps to add extra air rings, and new cyclones.

The riser mixer (if used), the coke combustor, and the dilute phase transport riser require no modification.

The only modification that is strongly recommended for existing high efficiency regenerators is incorporation of a means at the exit of the dilute phase transport riser to rapidly and completely separate catalyst from steam laden flue gas. The steam laden flue gas should be isolated from the catalyst collected in the second fluidized bed. Preferably a closed cyclone system is used to separate and isolate steam laden flue gas from catalyst.

Preferably much, even most, coke combustion occurs in the drier second fluidized bed. Temperatures in the second fluidized bed are high, so rapid coke combustion can be achieved even in a bubbling fluidized bed.

The present invention also permits continuous on stream optimization of catalyst regeneration. Two powerful and sensitive methods of controlling air addition rates permit careful fine tuning of the process. Achieving a significant amount of coke combustion in the second fluidized bed of a high efficiency regenerator also increases the coke burning capacity of the unit, for very little capital expenditure.

Measurement of oxygen concentration in flue gas exiting the transport riser, and to a lesser extent measurement of CO or hydrocarbons or oxidizing or reducing atmosphere, gives refiners a way to make maximum use of air blower capacity.

Measurement of delta T, when cyclone separators are used on the regenerator transport riser outlet, provides a very sensitive way to monitor the amount of afterburning occurring, and provides another way to maximize use of existing air blower capacity.

Partial CO combustion in the first and second stage will minimize the damage done to the catalyst by metals (primarily Ni and V), will minimize NOx emissions, and increase the coke burning capacity of the FCC, by shifting some of the work of coke burning to the second fluidized bed. It may be necessary to bring in auxiliary compressors, or a tank of oxygen gas, to supplement the existing air blower. Although many existing high efficiency regenerators can, using the process of the present invention, achieve large increases in coke burning capacity by shifting the coke combustion to the second fluidized bed, the existing air blowers will almost never be sized large enough to take maximum advantage of the heretofore dormant coke burning capacity of the second fluidized bed.

Operation with both stages in partial CO combustion is also possible, and preferred for maximizing coke burning potential of the high efficiency regenerator design. This may seem a strange use of the high efficiency regenerator, originally designed to achieve complete CO combustion, but there are many benefits.

Coke combustion is maximized by partial CO combustion, as is well known. One mole of air is needed to burn one mole of carbon to CO2, while only half as much air is needed to burn the carbon to CO. This roughly doubles the coke burning capacity of the unit, and shifts much of the heat generation, and high temperature, to a downstream CO boiler.

Partial CO combustion slashed NOx emissions, and greatly minimizes formation of highly oxidized forms of V. These are known benefits of partial CO combustion, but difficult to achieve in practice because the units are hard to control in partial CO combustion mode, especially when a CO combustion promoter such as Pt is present.

We claim:

1. A process for regenerating spent fluidized catalytic cracking catalyst used in a catalytic cracking process wherein a heavy hydrocarbon feed stream is preheated in a preheating means, catalytically cracked in a cracking reactor by contact with a source of hot, regenerated cracking catalyst to produce cracked products and spent catalyst which is regenerated in a high efficiency fluidized catalytic cracking catalyst regenerator comprising a fast fluidized bed coke combustor having at least one inlet for spent catalyst, at least one inlet for regeneration gas, and an outlet to a superimposed dilute phase transport riser having an inlet at the base connected to the coke combustor and an outlet the top connected to a separation means which separates catalyst and primary flue gas and discharges catalyst into a second fluidized bed, to produce regenerated cracking catalyst comprising regenerating said spent catalyst in at least two stages, and maintaining partial CO combustion conditions, including the presence of at least 1.0 mole % CO in the flue gas, in both stages by:

a) partially regenerating said spent catalyst with a controlled amount, sufficient to burn from 10 to 90% of the coke on the spent catalyst to carbon oxides, of a primary regeneration gas comprising oxygen or an oxygen containing gas in a primary regeneration zone having a temperature comprising said coke combustor and transport riser and discharging from the transport riser partially regenerated catalyst and a primary flue gas stream having a temperature and at least 1.0 % CO;

b) completing the regeneration of said partially regenerated catalyst with a controlled amount of a secondary regeneration gas comprising oxygen or an oxygen containing gas in a secondary regeneration zone comprising said second fluidized bed and burning additional coke to carbon oxides and produce a secondary flue gas stream having a temperature and at least 1.0 % CO; and c) controlling the amount of primary and secondary regeneration gas relative to coke on spent catalyst to limit combustion of coke in each regeneration stage to produce a flue gas from each stage comprising at least 1 mole % CO and wherein the secondary combustion air is set at a constant rate and the primary combustion air is varied to maintain constant a flue gas composition in flue gas from said second fluidized bed or to maintain constant a differential temperature indicating afterburning in flue gas from said second fluidized bed.

2. The process of claim 1 wherein the flue gas from the primary combustion zone and the flue gas from the secondary combustion zone are mixed together to produce a combined flue gas stream, the secondary combustion air is set at a constant rate, and the primary combustion air is set to maintain constant a flue gas composition in said combined flue gas stream or to maintain constant a differential temperature indicating afterburning in said combined flue gas stream.

3. The process of claim 1 wherein the second fluidized bed comprises a bubbling dense phase fluidized bed.

4. A process for regenerating spent fluidized catalytic cracking catalyst used in a catalytic cracking process wherein a heavy hydrocarbon feed stream is preheated in a preheating means, catalytically cracked in a cracking reactor by contact with a source of hot, regenerated cracking catalyst to produce cracked products and spent catalyst which is regenerated in a high efficiency fluidized catalytic cracking catalyst.

5. The process of claim 4 wherein the apportionment of regeneration air to said primary and secondary stages is based on the temperature difference between said fast fluidized bed in said primary stage and said second fluidized bed.

6. The process of claim 4 wherein a constant amount of regeneration gas added to said regenerator, and said constant amount is apportioned between said primary and secondary stages to maintain constant a temperature difference between said primary stage and said secondary stage, and the amount of coke relative to the amount of regeneration gas is set by adjusting the feed preheat, the feed rate or both to change the coke production.

7. The process of claim 4 wherein a constant amount of regeneration gas added to said regenerator, and said constant amount is apportioned between said primary and secondary stages to maintain constant at least one flue gas composition from said primary stage and said secondary stage, and the amount of coke relative to the amount of regeneration gas is set by adjusting the feed preheat, the feed rate or both to change the coke production.

8. The process of claim 6 wherein the feed rate is changed to change the coke production.

9. The process of claim 6 wherein the feed preheat is changed to change the coke production.

10. The process of claim 4 wherein at least a portion of the catalyst from the second fluidized bed is recycled to the coke combustor.

11. The process of claim 4 wherein the spent catalyst is added to said coke combustor via a riser mixer having an inlet in a base portion thereof for said spent catalyst, recycled regenerated catalyst from said second fluidized bed, and for regeneration gas, and an outlet in an upper portion of said riser mixer in a lower portion of said coke combustor.

12. The process of claim 11 wherein the amount of regeneration gas added to said primary regeneration zone is split between said coke combustor and said riser mixer.

* * * * *